US007802390B2

(12) United States Patent
Reis

(10) Patent No.: US 7,802,390 B2
(45) Date of Patent: Sep. 28, 2010

(54) CONFIGURABLE MODULAR PICTURE FRAME

(76) Inventor: Richard C. Reis, 17 Benburb Rd., Phoenixville, PA (US) 19460

( * ) Notice: Subject to any disclaimer, the term of this patent is extended or adjusted under 35 U.S.C. 154(b) by 99 days.

(21) Appl. No.: 12/247,299

(22) Filed: Oct. 8, 2008

(65) Prior Publication Data

US 2010/0083548 A1 Apr. 8, 2010

(51) Int. Cl.
*G09F 7/04* (2006.01)

(52) U.S. Cl. ..... 40/711; 40/741; 40/749; 40/761; 40/781

(58) Field of Classification Search ..... 40/745–764, 40/780, 781, 711, 711.04, 711.05, 711.08
See application file for complete search history.

(56) References Cited

U.S. PATENT DOCUMENTS

| | | | | | |
|---|---|---|---|---|---|
| 1,058,348 | A | | 4/1913 | Blumenthal | |
| 1,356,575 | A | * | 10/1920 | Weiss | 40/746 |
| 2,790,259 | A | | 8/1954 | Havens | |
| 2,819,546 | A | * | 1/1958 | Repholz | 40/536 |
| 2,819,549 | A | * | 1/1958 | Tester | 40/739 |
| 3,548,527 | A | * | 12/1970 | Acosto et al. | 40/754 |
| 3,553,872 | A | | 1/1971 | Ebner | |
| 3,553,873 | A | | 1/1971 | Weston | |
| 3,579,886 | A | * | 5/1971 | Hughes | 40/773 |
| 3,885,336 | A | | 5/1975 | Olsen | |
| 3,965,600 | A | | 6/1976 | Paskerian | |
| 3,990,670 | A | | 11/1976 | Frechtman | |
| 4,136,470 | A | | 1/1979 | Barz | |
| 4,211,382 | A | | 7/1980 | Bonfils | |
| 4,624,067 | A | | 11/1986 | Kristofich | |
| 4,912,864 | A | | 4/1990 | Price | |
| 4,989,353 | A | | 2/1991 | Astolfi | |
| 5,012,601 | A | | 5/1991 | Garland et al. | |
| 5,033,141 | A | | 7/1991 | Kang | |
| 5,056,250 | A | * | 10/1991 | Weissleder et al. | 40/539 |
| 5,077,921 | A | | 1/1992 | Mooney | |
| 5,148,618 | A | * | 9/1992 | Brewster | 40/626 |
| 5,195,263 | A | | 3/1993 | Huang | |
| 5,269,083 | A | * | 12/1993 | Vampatella et al. | 40/711 |
| 5,307,574 | A | * | 5/1994 | Huff, Jr. | 40/781 |
| 5,335,434 | A | * | 8/1994 | Shultz et al. | 40/766 |
| 5,451,026 | A | | 9/1995 | Smith | |
| 5,713,148 | A | | 2/1998 | Lovison | |
| 5,950,342 | A | * | 9/1999 | Suesholtz | 40/768 |
| 6,282,827 | B1 | | 9/2001 | Holmes | |

(Continued)

*Primary Examiner*—Lesley Morris
*Assistant Examiner*—Shin Kim
(74) *Attorney, Agent, or Firm*—Stradley Ronon Stevens & Young, LLP

(57) ABSTRACT

A picture frame for holding and displaying content. The picture frame has an edge with a channel receiving the content. An edge segment is attachable to and detachable from the remainder of the edge, using magnets, to allow insertion and removal of the content. A back has a front face to which the edge remainder is attached and a rear face including one or more magnets for attaching the back to a magnetically attractive surface. An optional stand has a plurality of elements that engage at least one of the back magnets to support the back in multiple directions and orientations. An optional hanger is made of a magnetically attracted material for engaging at least one of the back magnets and attach the hanger to the back. The hanger is configured to engage a fastener and hang the picture frame from the fastener when the stand is not in use.

20 Claims, 6 Drawing Sheets

U.S. PATENT DOCUMENTS 6,354,030 B1 3/2002 Harris
6,400,247 B1 6/2002 King
6,574,896 B1 * 6/2003 Howell ..... 40/737
6,688,029 B1 2/2004 Dunn
6,868,630 B2 * 3/2005 Kim ..... 40/711
6,962,017 B1 * 11/2005 Pounds ..... 40/781
7,069,682 B2 7/2006 Gatt et al.
7,114,278 B2 10/2006 Marks et al.
7,228,654 B2 6/2007 Stravitz
7,296,373 B1 11/2007 Hahn

* cited by examiner

CONFIGURABLE MODULAR PICTURE FRAME

TECHNICAL FIELD

The present invention relates generally to picture frames and display frames or holders and, more particularly, to picture frames and display frames or holders having components that are conveniently assembled and easily manufactured.

BACKGROUND OF THE INVENTION

The phrase "picture frame" is used in this document for convenience of description to refer to a picture or display frame or holder for holding and displaying virtually any type of substantially flat item ("content"). The content held and displayed in the picture frame may include a piece of artwork (e.g., prints, paintings, water colors, and drawings), photograph, citation, certificate, document, diploma, mirror, tapestry, poster, calendar, chart, restaurant menu, transportation timetable, leaflet, advertisement, and the like.

Picture frames are well known in the art. Such frames usually include a main frame element having on three sides a channel into which are inserted, from the open end, first a sheet of glass, then the content to be displayed, then one or more sheets of cardboard, and finally a backing member. Wooden frames generally hold content with brads or small nails which are pounded into the back of the frame to securely hold the content within the frame for display. Metal frames may have metal tabs on the back of the frame for securing content within the metal frame.

It is often desired to replace the content within the picture frame with new content. For wooden frames, this operation is accomplished by removing the brads or nails. For metal frames, this operation is accomplished by bending the metal tabs up and away from the backing sheet or backing board. After the new content is placed in a wooden frame, brads or nails are pounded back into the wooden frame to secure the content. After the content is placed in a metal frame, the tabs of the metal frame are bent downwardly against the backing sheet or board to secure the content within the frame.

A disadvantage with conventional wooden frames is that pounding brads or nails into the wood is tedious and often leads to bent nails or brads and bruised thumbs when the tack hammer strikes the nail obliquely or misses the nail completely to strike the hand of the user. A disadvantage with metal frames having metal tabs is that bending the metal tabs to change the content cold works the metal and makes it brittle. Accordingly, metal tabs may soon break off and the frame will thereby eventually become unusable. Another disadvantage is that these operations are time consuming. The operations of inserting, securing, and replacing the content are cumbersome and do not afford quick and easy access to the content.

Picture frames are often used to display content when hung on a vertical surface such as the wall of a building. To facilitate the hanging operation, the main frame or the backing member includes a mounting device for attachment to the vertical surface. The mounting device can be any known device such as saw tooth hangers, mounting holes for receiving screws or nails, braided wire or cable loops, hooks, and the like. The picture frame typically swings downward with the lower edge in engagement with the wall. In addition to the often difficult problem of aligning the picture frame properly on the wall using these conventional devices, the related problem exists of securing the picture frame once aligned.

Numerous securing devices are on the market for securing picture frames into an aligned position. These devices have numerous drawbacks. One such device, for example, includes double adhesive tape strips which are secured to the back of the main frame and to the wall for securing the picture frame into position. The problem with this arrangement is that it is difficult to temporarily dismount the picture frame and remount the picture frame in an aligned position. It would be necessary to obtain new securing pads and replace the old ones with the new ones any time the picture frame is moved.

These common hanging mechanisms are also limited in their versatility. The user cannot easily convert the hanging picture frame for placement on a horizontal support surface such as a countertop or desk. Moreover, individual picture frames are generally unable to assume a variety of geometric configurations whether hung on a wall or placed on a horizontal surface. A typical picture frame is unable to rest on a horizontal surface, for example, at a plurality of angles relative to the surface.

To address part of this versatility problem, a convertible picture frame is used, whereby the picture frame is convertible between hanging on a wall and standing on a horizontal support surface. For hanging on a wall with this type of convertible picture frame, the picture frame usually has a heavy paper or cardboard backing member with a small, semi-circular tab die-cut in the backing member and a hole in the center of the tab. The semi-circular tab is bent out from the plane of the backing member and the hole is hooked over a small nail driven into a wall. In such a case, the picture frame essentially lies flat against the wall.

On the other hand, for mounting on a shelf, a small fold-out easel is usually die-cut from the backing member. To assemble, the easel leg is bent perpendicular to the original plane of the backing member and a small locking tab secures the leg in this position. The picture frame can then be positioned on a shelf in a stable position with a slight slope for easy viewing.

The convertible picture frames are not easily convertible from hanging on a wall to placement on a horizontal support surface, however, as significant assembly of the backing member is required for the conversion. Further, using a particular convertible picture frame with a specific content limits the use of another frame which might otherwise be more aesthetically preferable for use with that particular content. Still further, the heavy paper or cardboard backing member providing the versatility is insufficiently sturdy to (a) support heavy content, or (b) withstand the rigors of extended use. Finally, the presence of the die or easel sometimes hinders access to the brads, nails, or hooks, thereby making the operation of replacing content difficult.

In the related art, it is common practice to adorn the exterior of household appliances such as refrigerators with an object (most typically a photograph, drawing, or list) which is typically adhered to the appliance surface using magnets. Refrigerator magnets assume a variety of forms. Regardless of form, however, they typically have sufficient strength to hold both themselves and the object to the appliance.

A problem perceived with the use of ordinary refrigerator magnets to secure objects to appliances is that the appliance adopts a sloppy appearance. Any irregular edges on the object are visible, for example, and give a cluttered and disorderly appearance. Another problem is the high cost of each of the magnets necessary to secure objects to appliances. Yet another problem with the known refrigerator magnets is the fact that the magnets partially hide the objects they attach. A further problem is that the magnetic force due to a single magnet may be insufficient to support a heavy object, such as a large sheet of paper, especially if the paper is slippery.

Another known magnetic attachment device includes magnetic sheet material cut into picture frame shapes. The exposed side of the magnetic surface is coated with colors or designs to make it more aesthetically pleasing. But the fragility of this material can lead to easy tearing. Still another known frame with magnetic components for use on refrigerators and other metal objects uses plastic hollow tubing. Magnets are affixed to the inside of the tubing in order to secure the frame and content to the metal object. Again, this material is fragile and breakable if dropped.

In summary, conventional picture frames are problematic for the user in a number of ways. Wall-mounted frames will often prove difficult to change the content. Desktop frames frequently provide an easier mechanism to change the content, but are often aesthetically unappealing when viewed from the back or side. Many also deteriorate over time after they are used for extended periods or as the contents are changed. Such deterioration is due to flimsy metal clips and paper backings. Frames that are mountable on a refrigerator are simplistic and one-dimensional. No frame can be used for all situations. In addition, because the content of the picture frame is usually a significant item, the picture frame should enhance the content when viewed from any angle rather than detract from the content. The orientation of frames proves to be problematic with many frames, particularly wall frames, because new content may require the frame to be oriented in another direction.

To address these problems and to overcome the shortcomings of conventional picture frames, a configurable modular picture frame is provided. An object of the present invention is to provide an improved picture frame having the ability to rapidly change the content, readily reconfigure for mounting on vertical or horizontal surfaces, and reorient. A related object is to provide a picture frame having a quick connect and quick disconnect mechanism for inserting, securely retaining, and easily removing content with a minimum of effort. Accordingly, it is another object of the present invention to provide a picture frame which does not require the use of brads, nails, metal tabs, wedges, or clumsy clamps for holding content in place.

An additional object is to provide a picture frame which rests on a horizontal support surface such as a countertop or desk at a plurality of angles relative to the surface. A related object is to provide a mechanism for semi-permanently securing a picture frame into an aligned position. In addition, because many conventional picture frames deteriorate fairly quickly, it would be desirable to have a mounting mechanism that is durable. It is a particular object of the present invention to provide an improved picture frame capable of receiving various sizes of content, no greater than a predetermined maximum size, in different orientations, such as in both the portrait mode and the landscape mode.

Another object is to minimize the risk of damage to the content, the picture frame, or both when inserting, removing, or reorienting content. It is still another object of the present invention to provide a picture frame which itself has a unique artistic value that enhances the artistic merits of the content and looks attractive from all viewing angles. Thus, a related object is to assure that all picture frame components combine to form an aesthetically attractive picture frame such that none of the components need be shielded from view.

BRIEF SUMMARY OF THE INVENTION

To achieve these and other objects, and in view of its purposes, the present invention provides a picture frame for holding and displaying content. The picture frame has an edge made of a material that is not magnetically attracted, the edge having at least one edge segment that is attachable to and detachable from the remainder of the edge, and the edge having a channel for receiving the content. A back is made of a material that is not magnetically attracted and has a front face to which the edge remainder is attached along a perimeter of the back and a rear face including at least one back magnet for attaching the back to a magnetically attractive surface. At least one edge magnet is located on the edge segment. At least one edge cooperating element is located on one of the edge remainder or on the back, the at least one edge cooperating element engaging the at least one edge magnet to affix the edge segment to the edge remainder and complete the edge around the periphery of the back.

An optional stand has a plurality of elements that engage the at least one back magnet to support the back in multiple directions and orientations. An optional hanger is made of a magnetically attracted material for engaging the at least one back magnet and attaching the hanger to the back. The hanger is configured to engage a fastener and hang the picture frame from the fastener when the stand is not in use.

The present invention achieves its objects and addresses the shortcomings of the conventional picture frames in a variety of ways. When all of these objects are considered together, it becomes necessary to break the picture frame into components such that its parts can be separated from each other, if and when desired, and subsequently reattached, possibly in a different configuration. The picture frame of the present invention has a number of rapidly separable pieces, including a rapidly removable part to access the content and provide the desired quick-change feature. There are a number of components that make up the picture frame and each of these can be treated separately or, alternatively, as part of a subassembly. Prefabricated subassemblies can use any mechanism of permanent attachment, but the individually separable components must have a mechanism of attachment that is neither permanent nor difficult to separate.

In order to solve the problem of access to the content, it is necessary to be able to remove one or more edges of the picture frame or, alternatively, the entire front edge of the frame from the back if the front edge is a complete subassembly. In order to enable the reconfiguration from a refrigerator mount, to a desktop mount, and to a wall mount, it is necessary to be able to remove the unneeded component and possibly replace it with the suitable component. The picture frame includes magnets for mounting on metal (e.g., steel, iron, other ferrous metals, or other metallic substances that are attracted to a magnet) objects such as appliances (e.g., a refrigerator), filing cabinets, or the like. The hanger mechanism enables wall mounting.

To solve the orientation problem, it is necessary to be able to pivot or move the mounting mechanism to a different area of the picture frame. The picture frame has the ability to pivot around a point and to mount at different areas. A separable mounting mechanism for a horizontal surface that can be made from visually appealing materials solves the appearance problem. In order to make the picture frame more appealing when viewed from the back, for example, the picture frame includes a base that will not detract from the appearance of the other frame components.

It is to be understood that both the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Figure 1B:
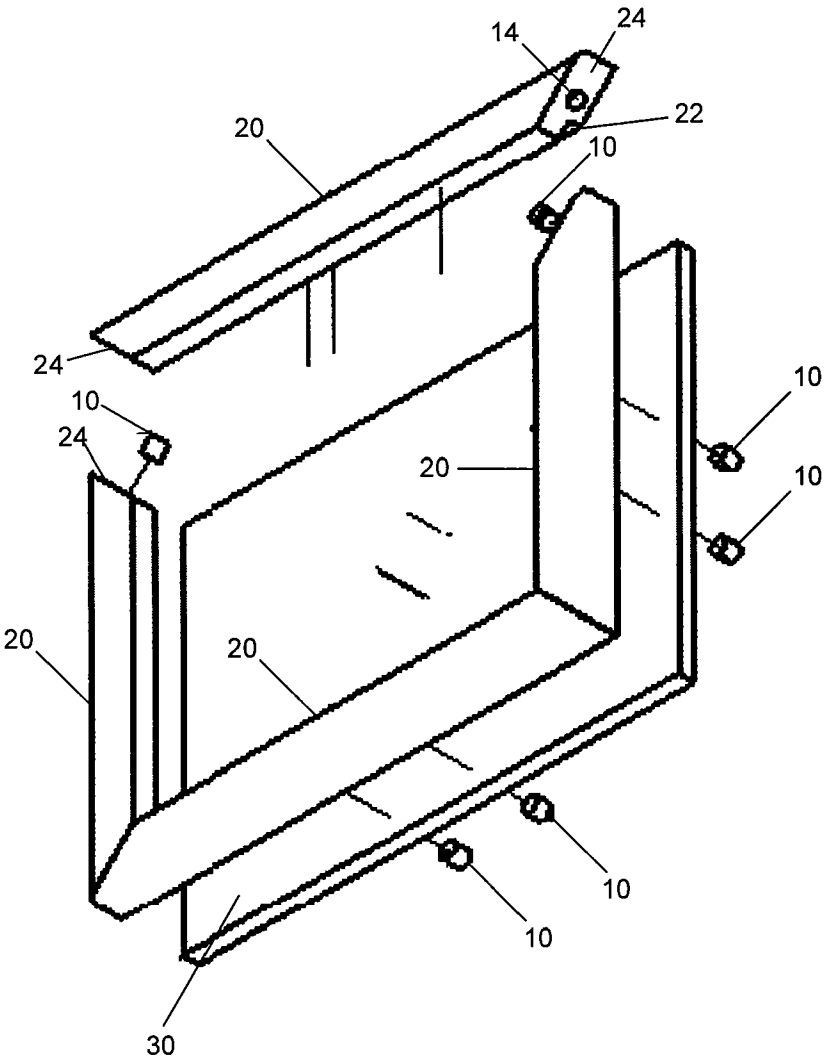
FIG. 1B is a front exploded and perspective view of the frame components illustrated in FIG. 1A.

The present invention is directed to a picture frame with securely held, but easily detachable and reattachable, modular components. The main components are: an attachment mechanism such as magnets 10; frame edges 20; a frame back 30; a frame stand, base, or brace 40; and a frame hanger 70. Each of these main components may be made of one or more modular subcomponents. Any of the pieces could be treated as individual components that are independently detachable or preassembled into groups where only some components are detachable. At least one component will always be detachable. The purpose for allowing the detachment is to enhance the ease in changing the content of the picture frame, configuration of the picture frame, orientation of the picture frame, or mounting of the picture frame.

General examples of how the picture frame can be used according to the invention are to: remove one or more sides (or all sides as a preassembled unit) in order to remove or replace the content; add or remove a hanger that allows for hanging on a vertical surface; reorient the hanger to allow reoriented placement on the vertical surface; add or remove a stand that allows for use on a horizontal surface; reorient the stand to allow reoriented placement on the horizontal surface; or mount directly on a vertical or horizontal surface without a hanger or stand. The following specific examples are included to more clearly demonstrate the overall nature of the invention. These examples are exemplary, not restrictive, of the invention. The picture frame is illustrated in the figures in several of its possible forms.

EXAMPLES

Referring now to the drawing, in which like reference numbers refer to like elements throughout the various figures that comprise the drawing, the figures display several, exemplary, basic components of the picture frame. The various non-attachment components of the picture frame can be made from many rigid or semi-rigid materials including, but not limited to, wood, plastic, metal, ceramics, rock, or composite materials. Multiple materials can be combined either within a component or alternatively individual components could be of a different material than other components. There are a large number of alternative combinations, because each individual component can be assembled by non-permanent attachment rather than preassembled into a permanently attached subassembly. The attachment mechanism can be any mechanism capable of securely attaching the components while still being detachable and reattachable, including magnets, hook-and-loop fasteners, or non-permanent adhesives.

A. An Example Frame and Back

Figure 1A:
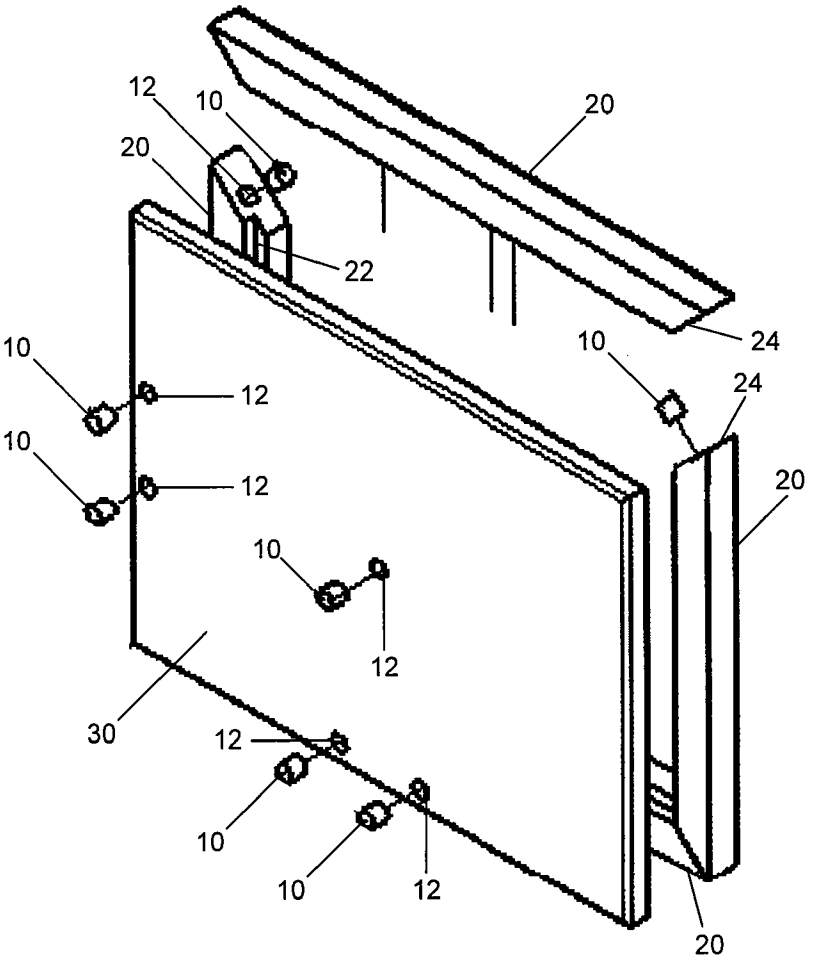
FIG. 1A is a rear exploded and perspective view of an exemplary embodiment of frame components with a set of preassembled subcomponents according to the present invention.

In the embodiment illustrated in FIGS. 1A and 1B, the attachment mechanism includes a permanent magnet 10. The other components must not be made of magnetically attractive material when magnets 10 form the attachment mechanism. Wood is a preferred material of construction.

The other components displayed include the back 30 of the picture frame and the frame sides or edges 20. Each of the edges 20 and the back 30 are potentially separate components. As illustrated in the embodiment of FIGS. 1A and 1B, however, three of the edges 20 are permanently attached to each other as well as to the back 30. The back 30 of the picture frame may be an integral part of another object, such as a keepsake box, the side of a dresser, or the wall of a house. The only removable piece in this embodiment is one of the edges 20 (i.e., the top edge 20 as illustrated), which is attached via magnets 10 to the other edges 20 (as shown), to the back 30, or to both components.

Each of the edges 20 has a U-shaped channel 22 to accommodate the content. The channel 22 of each edge 20 is oriented to that, when the edges 20 are assembled engaging each other, the channels 22 are inwardly facing and together form a generally U-shaped groove in a common plane. The channels 22 forming the groove may taper inwardly to improve frictional engagement (directly or indirectly) with the content and, therefore, to more securely hold the content in position.

The removal of the top edge 20 permits the insertion and removal of the display content. In addition to the insertion and removal of the display content, the edges 20 and their channel 22 may be sized and shaped to permit the insertion and removal of other elements commonly used to enhance the display content. Such elements may include, for example, a transparent sheet, matting, or both (neither conventional element is shown).

Typically, a transparent sheet, such as a sheet of glass, is provided. Rather than glass, especially to improve safety in certain applications, the transparent sheet may be any transparent rigid or semi-rigid material including Plexiglas® (a registered trademark of Arkema, Inc.), plastic, vinyl, acrylics, polymers, or safety glass. The content is laid on the transparent sheet with its face exposed to view and with the transparent sheet protecting the content. The transparent sheet keeps the content free from atmospheric dust and free from dirt or oil such as is normally found on the hands of a viewer of the content or a person handling the picture frame.

Some users like to include matting in their picture frames. The matting can provide a clean border of white or another solid (single) color in order to border and thus emphasize the content being displayed. In some cases, more than one matting sheet may be used in contrasting colors.

Preferably, although not necessarily because squared edge ends are possible, the ends of each edge 20 are angled to provide a bevel 24 so that the edges 20 fit together properly at the comers of the picture frame. In the preferred embodiment, the ends of each edge 20 are cut on the bias at a forty-five degree angle to form miter joints at the four comers of the picture frame. Each edge 20 preferably has a relatively low weight per unit length. By using low weight edges 20, it is possible to have a low weight frame structure that can be magnetically adhered to a steel refrigerator surface without danger of gravitationally falling away. Two or three of the edges 20 can be adhesively secured together.

Although a rectangular picture frame is illustrated, other shapes for the picture frame (i.e., round, circular, oval, elliptical, and the like) are possible. For each shape, however, a section of the edge must be removable to permit insertion of the content. The completed picture frame may be of various sizes, e.g. nine inch by twelve inch; five inch by seven inch; or three inch by five inch rectangles.

One or more magnets 10 may be provided on the back 30 (or on the rear of one or more edges 20 if the picture frame has no back 30). In the embodiment illustrated in FIGS. 1A and 1B, five magnets are shown embedded in the back 30 to be used in various configurations. Two magnets 10 form a pair located on opposites sides of the center along the short length of the rectangular picture frame, two magnets 10 form a pair located on opposite sides of the center along the long length of the rectangular picture frame, and one magnet 10 is located in the center of the picture frame.

As illustrated in FIGS. 1A and 1B, the picture frame could be directly mounted either horizontally or vertically on a magnetically attractive surface (or to a magnet or magnetically attractive plate affixed on the surface) and oriented in any direction on that surface. In addition, with a hanger 70 mounted between one pair of magnets 10 (see FIG. 6A), the picture frame can be mounted on a vertical surface using a conventional nail or hook protruding from that surface. The magnet 10 in the center of the back 30 can be used to attach the picture frame to a vertical surface or to a variety of possible stands for upright use on a horizontal surface.

The magnets 10 suitable for use in the picture frame of the present invention can be selected from the variety of magnets commercially available. An integral magnet disc is preferred (by "integral" is meant a single piece or a single unitary part that is complete by itself without additional pieces, i.e., the part is of one monolithic piece formed as a unit with another part). Other examples are possible, however, including a magnetic rubber strip such as is commonly used in refrigerator doors. It is common knowledge that the magnetic effect of such magnetic rubber is enhanced if it is backed by a metallic element. Another example is magnetic plastic tape.

If the attachment mechanism includes a magnet 10, it also includes a counterpart or cooperating element 14 (see FIG. 1B). The cooperating element 14 may be another magnet or a metallic plate to complete an attachment mechanism. Magnets 10 are typically polarized so that they have north and south poles along opposite edges. Accordingly, the magnets 10 and their cooperating elements 14 must be properly oriented such that, in the case of two magnets 10 forming the pair of the attachment mechanism, the attracting poles are opposite one another when the components to be attached are aligned. The magnets 10 and their cooperating elements 14 will retain the picture frame components, and the picture frame itself, in a temporary or semi-permanent position. The components of the picture frame can then be removed simply by pulling the magnets 10 and their cooperating elements 14 apart.

Magnets 10 provide a holding force that may be called "dry compression," in that no intervening elements such as adhesives are required between the magnet 10 and its cooperating element 14. The size and strength of the magnet 10 can be predetermined to assure sufficient holding force for the particular application, with a stronger magnetic "pull" force for heavier or more slippery components. (By "predetermined" is meant determined beforehand, so that the predetermined characteristic—the size and strength of the magnet 10, for example—must be determined, i.e., chosen or at least known, in advance of some event such as construction of the picture frame or use of the magnet 10.) Because the parallel or shear forces between a magnet and a metal object are relatively weak, however, the components can be easily rotated through a relatively small arc about the connection to pivot the picture frame into its proper orientation or, if the rotational force is accompanied or replaced by a pull or separation force, to separate the components.

In all cases, the magnets 10 can be embedded in holes 12 provided in the component to which they are affixed. Preferably, the magnets 10 are inserted into blind holes 12 so that they are flush with one surface of the component. A blind hole is a hole that is reamed, drilled, milled, or otherwise formed to a specified depth; the etymology is that one cannot see through a blind hole (as opposed to a through hole). Thus, the magnets 10 do not add any extra dimensions to the components to which they are attached.

Although other shapes are possible, the holes 12 and magnets 10 of the illustrated embodiment are circular in nature and designed so that the magnets 10 fit snugly into the holes 12. The magnets 10 may be retained in the holes 12 via an interference fit, use of an adhesive, or a combination of such retention mechanisms. In a typical embodiment, the magnets 10 are not removable from the component to which they are attached. This configuration enhances the aesthetic appeal of the component while achieving the functional advantages offered by the magnets 10.

It would also be possible to cover a particular magnet 10 with a decorative cap, perhaps of the same material as the component to which the magnet 10 is attached. This configuration would "hide" the magnet 10 so that it is not visible to the user, further enhancing the aesthetic appeal of the components. Of course, the thickness and material of the cap must be selected so that the magnetic force is not diminished significantly between the capped magnet 10 and its cooperating element 14. The magnet 10 might be slightly recessed in the component so that the cap is flush with surface of the component.

B. A First Example Stand

Figure 2A:
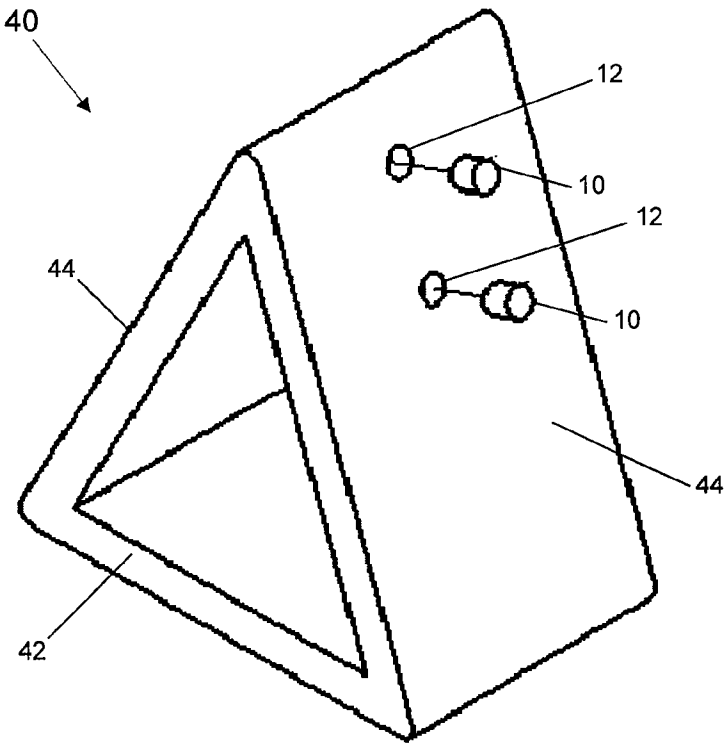
FIG. 2A is a perspective view of an exemplary embodiment of a stand with preassembled stand subcomponents according to the present invention.

FIG. 2A shows an angled stand 40 to be used to support the combination of the edges 20 and the back 30. In this embodiment, the stand 40 has three sides that are preassembled into the form of a triangle. Of course, other shapes are suitable—depending, in large part, on the aesthetic appearance desired. For the triangular stand 40 illustrated, however, a base 42 and two legs 44 form the stand 40. For a five inch by seven inch picture frame, for example, the stand 40 may have a base 42 about four inches in length and two equal legs 44 about five inches in length. The common width of the base 42 and legs 44 may be about 2.5 inches, and the thickness of all subcomponents may be about 0.25 inches. The angle between the legs 44 and the base 42 in this example, which corresponds to the display angle for the content, is about seventy degrees above horizontal.

Magnets 10 are inserted into holes 12 disposed in stand 40 to permit the picture frame to be oriented either in a horizontal (i.e., landscape) or a vertical (i.e., portrait) direction. In either case, the picture frame is angled. As illustrated in FIG. 2A, the magnets 10 are disposed in one of the legs 44. The spacing between the magnets 10 in this case is about half the difference between the length and width of the picture frame itself. Thus, for a five inch by seven inch picture frame, for example, the magnets 10 are located about three inches and four inches respectively from the base 42 and positioned centrally with respect to the width of the leg 44. To support the picture frame in the vertical direction in this example, the top magnet 10 (located about four inches from the base 42) engages the center magnet 10 of the back 30; to support the picture frame in the horizontal direction, the bottom magnet 10 (located about three inches from the base 42) engages the center magnet 10 of the back 30 (and, of course, the back 30 and edges 20 are rotated by ninety degrees).

The stand 40 need not be shielded from view, as are most conventional stands. Instead, the stand 40 provides an aesthetically attractive continuation of the frame edges 20 and back 30. The stand 40 provides an appropriate display angle for the content when placed on a horizontal support surface. Moreover, even if previously hung on walls, the picture frame may easily be converted for placement on a horizontal surface such as a countertop or desk using the stand 40.

Figure 2B:
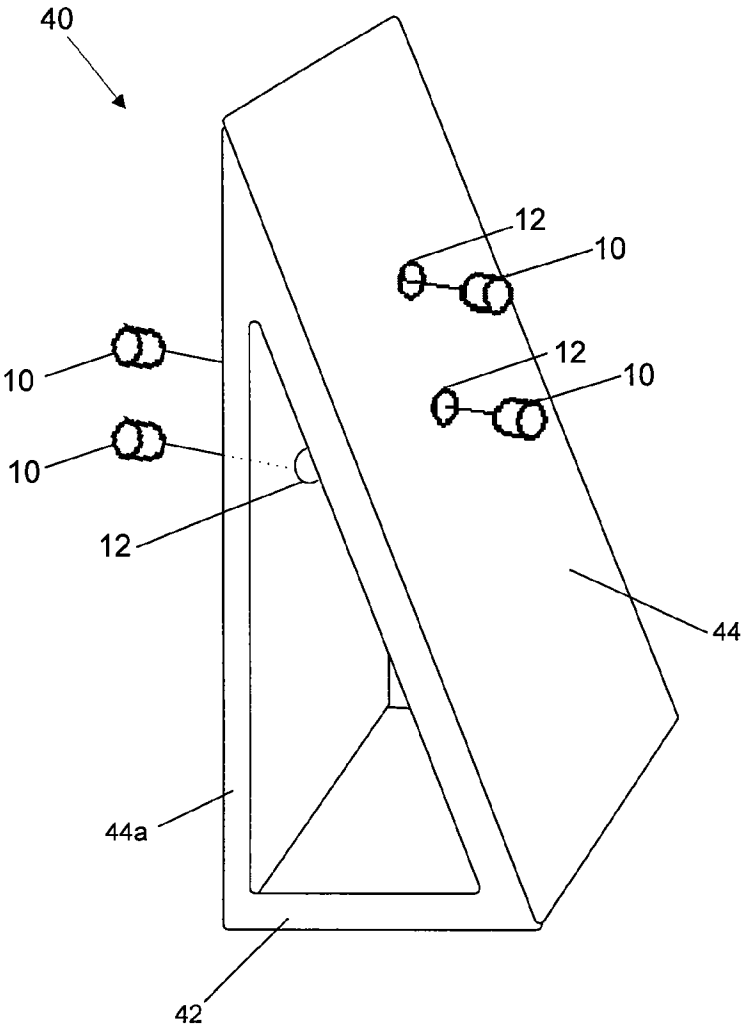
FIG. 2B is a perspective view of a variation of the exemplary embodiment of the stand shown in FIG. 2A.

FIG. 2B is a perspective view of a variation of the exemplary embodiment of the stand shown in FIG. 2A. In this variation, one of the legs 44*a* is perpendicular to the base 42. Thus, the angle between the leg 44*a* and the base 42 is ninety degrees, which again corresponds to the display angle for the content when the picture frame is supported on the leg 44*a*. Like the stand illustrated in FIG. 2A, the stand variation of FIG. 2B permits the picture frame to be oriented either in the landscape or the portrait direction. With the magnets 10 disposed in both of the legs 44 and 44*a*, however, this variation allows the user to orient the picture frame in either an angled or a vertical position by attaching the back 30 to the magnets 10 of the angled leg 44 or of the perpendicular leg 44*a*, respectively.

C. A First Example Frame and Stand Combination

FIGS. 3A, 3B, 3C, and 3D illustrate a picture frame formed by combining the edges 20 and back 30 of FIGS. 1A and 1B with the stand 40 of FIG. 2A. (Clearly, a picture frame could also be formed by combining the edges 20 and back 30 of FIGS. 1A and 1B with the stand 40 of FIG. 2B.) The combination is formed by magnetic attraction between the bottom magnet 10 of the stand 40 and the center magnet 10 of the back 30. For the particular orientation shown, the picture frame is in the landscape or horizontal direction. The base 42 of the stand 40 and the lowest edge 20 rest on a horizontal support surface such as a countertop, desktop, or shelf.

Figure 3A:
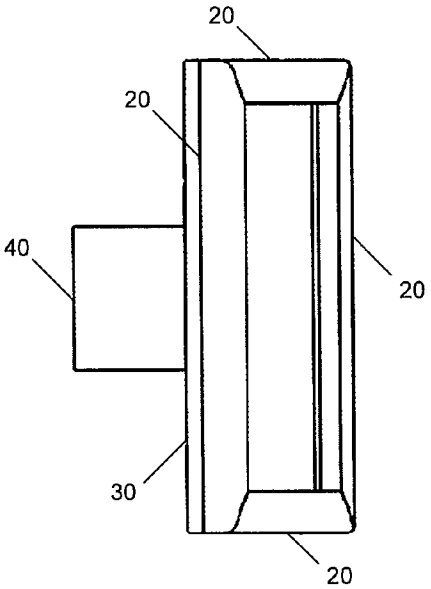
FIG. 3A is a top view of the combination of the frame components shown in FIGS. 1A and 1B with the stand shown in FIG. 2A configured for use on a typical desktop or shelf.
Figure 3B:
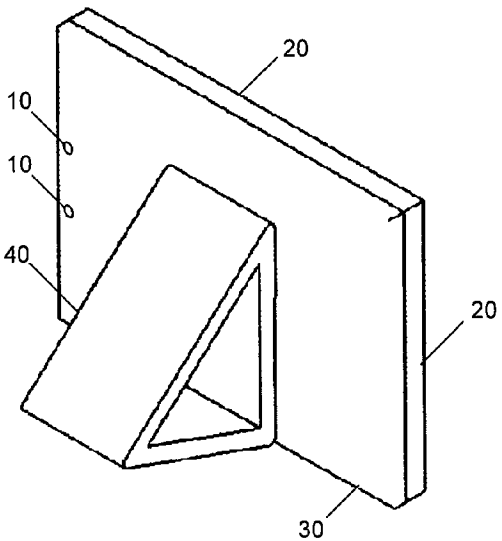
FIG. 3B is a rear perspective view of the combination illustrated in FIG. 3A.
Figure 3C:
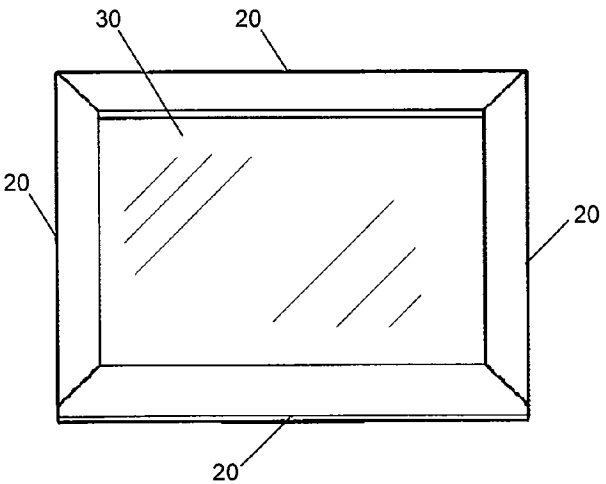
FIG. 3C is a front view of the combination illustrated in FIGS. 3A and 3B.
Figure 3D:
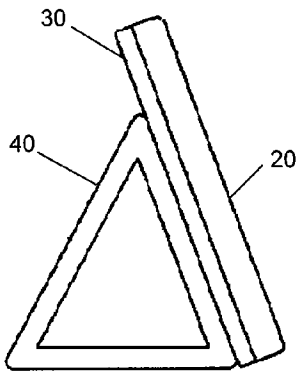
FIG. 3D is a side view of the combination illustrated in FIGS. 3A, 3B, and 3C.

FIG. 3A is a top view, FIG. 3B is a rear perspective view, FIG. 3C is a front view, and FIG. 3D is a side view of the combination forming the picture frame. These figures illustrate a typical countertop, desktop, or shelf use for the picture frame with an angled display for ease of viewing at the same level as the picture frame or from above. By using visually attractive materials for the edges 20, back 30, and stand 40, the picture frame is presentable and, in fact, aesthetically attractive from any angle of viewing, including the rear.

D. A Second Example Stand

Figure 4:
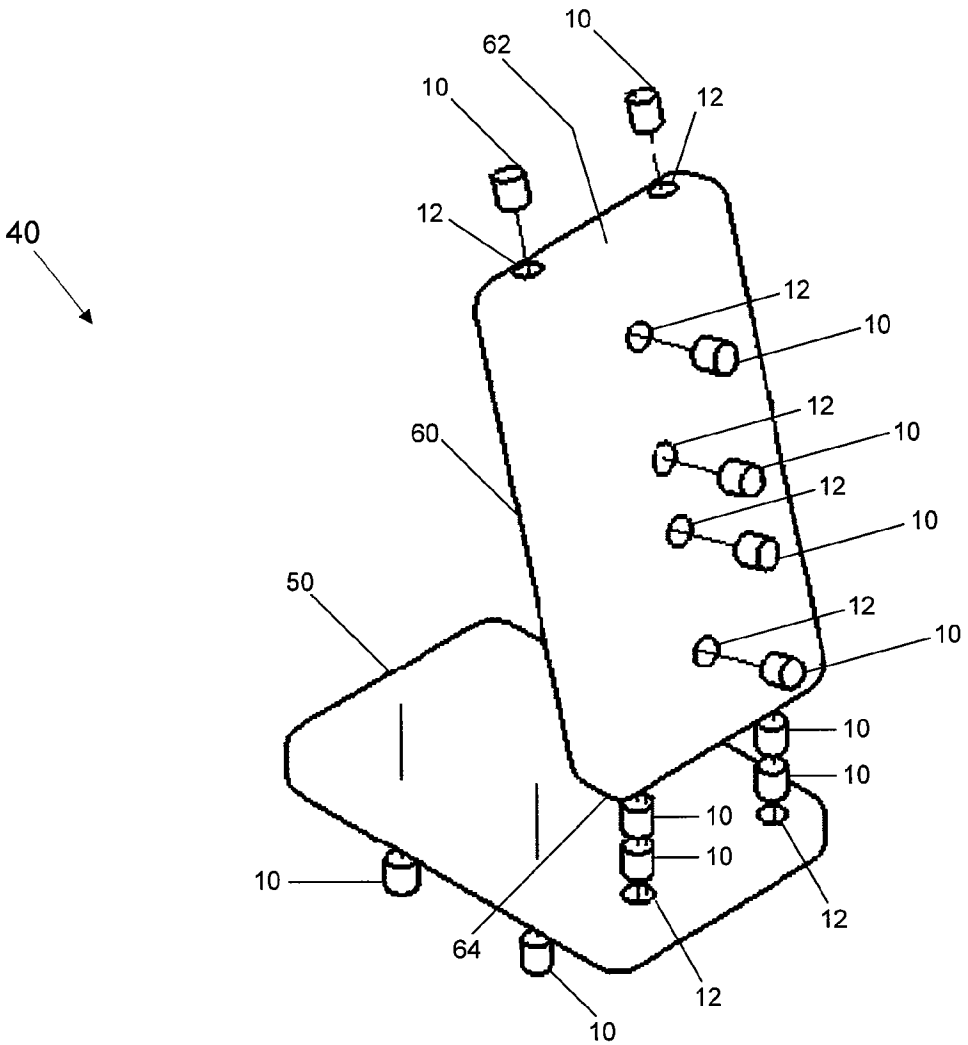
FIG. 4 is an exploded and perspective view of an exemplary embodiment of a configurable stand according to the present invention.

FIG. 4 shows another embodiment of the angled stand 40 to be used to support the combination of the edges 20 and the back 30 on a horizontal surface. In this embodiment, the stand 40 has two sub-components: a bottom 50 and a configurable upright 60. In the example shown, the upright 60 has a first end 62 that is substantially flat (to support the picture frame in a substantially vertical orientation) and a second end 64 that is angled (to support the picture frame in an angled orientation). The attachment components in this embodiment are magnets 10, which are used to connect the upright 60 to the bottom 50. As shown, each end 62, 64 of the upright 60 has a pair of magnets 10 configured to engage a corresponding pair of magnets 10 located proximate an edge of the bottom 50. Two corresponding pairs of magnets 10 are illustrated in FIG. 4 on opposite sides and proximate different edges of the bottom 50.

The stand 40 of FIG. 4 can be used in either a perfectly vertical alignment (see FIG. 5A) or in an angled alignment (as shown in FIG. 4). By inverting the configurable upright 60 and possibly the configurable bottom 50 as well, the stand 40 is converted between the two alignment positions. The stand 40 can be adjusted to various angles to accommodate various sizes of frames. The upright 60 of the illustrated embodiment is a rectangular component with approximate dimensions 4.5 inches in length, 2.5 inches in width, and 0.5 inches in thickness. The bottom 50 of the illustrated embodiment is also a rectangular component with approximate dimensions 3.5 inches in length, 2.5 inches in width, and 0.5 inches in thickness.

As shown, the upright 60 has four magnets 10 disposed along one surface. Each of the four magnets 10 is located substantially centrally with respect to the width of the upright 60. One magnet 10 is located about one inch from the first end 62 and 3.5 inches from the second end 64; a second magnet is located about two inches from the first end 62 and 2.5 inches from the second end 64; a third magnet is located about 2.5 inches from the first end 62 and two inches from the second end 64; and the fourth magnet is located about 3.5 inches from the first end 62 and one inch from the second end 64. This configuration of magnets 10 allows the stand 40 to support the edges 20 and back 30 in each of four positions—in both the horizontal (i.e., landscape) and vertical (i.e., portrait) directions and in both the non-angled (i.e., upright) and angled orientations—by engaging the center magnet 10 on the back 30.

E. A Second Example Frame and Stand Combination

Figure 5A:
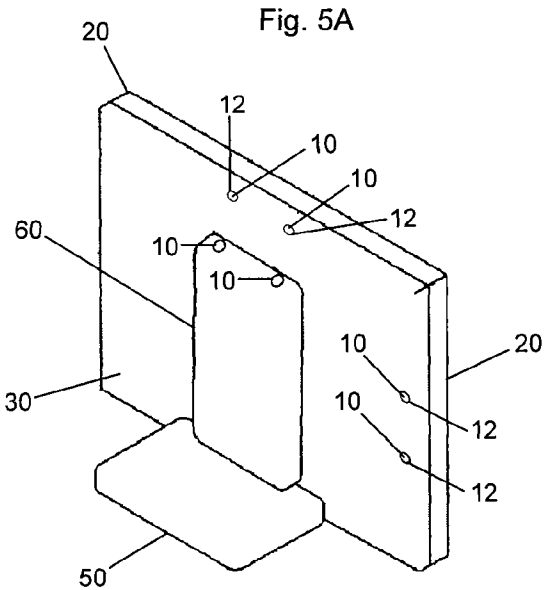
FIG. 5A is a rear perspective view of the combination of the frame components shown in FIGS. 1A and 1B with the stand shown in FIG. 4 configured for use on a typical desktop or shelf.
Figure 5B:
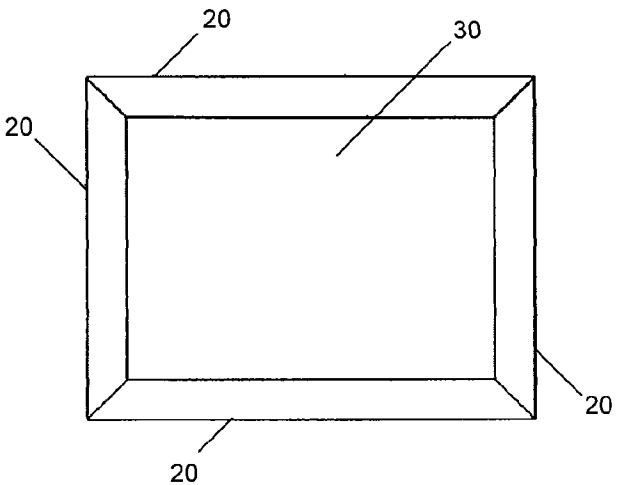
FIG. 5B is a front view of the combination illustrated in FIG. 5A.
Figure 5C:
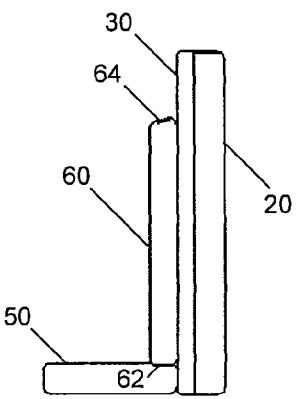
FIG. 5C is a side view of the combination illustrated in FIGS. 5A and 5B.

FIGS. 5A, 5B, and 5C illustrate a picture frame formed by combining the edges 20 and back 30 of FIGS. 1A and 1B with the stand 40 of FIG. 4. The combination is formed by magnetic attraction between one of the magnets 10 along the surface of the upright 60 (specifically, the third magnet which is located about 2.5 inches from the first end 62 and two inches from the second end 64) and the center magnet 10 of the back 30. For the particular orientation shown, the picture frame is in the landscape or horizontal direction and in the non-angled or upright orientation. The bottom 50 of the stand 40 rests on a horizontal support surface such as a countertop, desktop, or shelf. This is a typical countertop, desktop, or shelf use for the picture frame with a perfectly vertical display for ease of viewing from above, below, or at eye level.

FIG. 5A is a rear perspective view, FIG. 5B is a front view, and FIG. 5C is a side view of the combination forming the picture frame. These figures illustrate a typical countertop, desktop, or shelf use for the picture frame with a vertical or non-angled display. By using visually attractive materials for the edges 20, back 30, and stand 40, the picture frame is presentable and, in fact, aesthetically attractive from any angle of viewing, including the rear.

F. An Example Frame and Hanger Combination

As would be understood by an artisan, the picture frame of the present invention can be mounted on a flat, vertical surface such as a wall (or a metal appliance) without any stand 40 at all. A counterpart or cooperating element 14 such as a magnet or metallic plate (which is susceptible to magnetic attraction) can be mounted on the wall (no cooperating element 14 is necessary for mounting on a metal appliance). Then the back 30 of the picture frame can be located so that one of the magnets 10 positioned on the back 30 engages the cooperating element 14 on the wall. The attractive magnetic force will hold the picture frame in position on the wall. In addition, the force will help the user locate the cooperating element 14 on the wall, avoiding the often difficult task of engaging the hanging mechanism on a conventional picture frame with the wall holder. It is also possible to obviate the need for the back 30, by placing a magnet 10 on one of the rear surfaces of an edge 20 and having that magnet engage the cooperating element 14 on the wall.

Typically, walls have a wide variety of fasteners such as nails, screws, hooks, tacks, and the like to which conventional picture frames are often attached. FIGS. 6A, 6B, 6C, and 6D illustrate a picture frame according to the present invention formed by combining the edges 20 and back 30 of FIGS. 1A and 1B with a conventional hanger 70. The hanger 70 is configured to engage one of the conventional wall fasteners, allowing the user to hang the picture frame of the present invention on the conventional wall fastener (perhaps replacing a conventional picture frame).

Figure 6A:
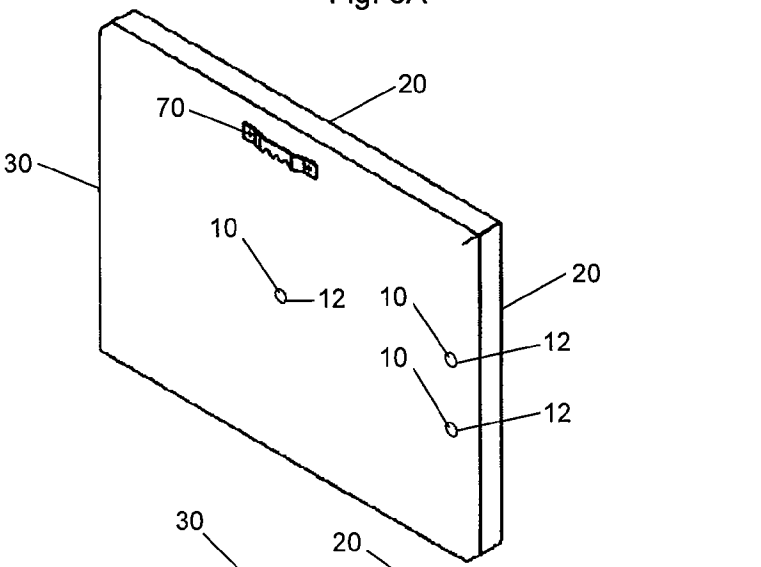
FIG. 6A is a rear perspective view of the combination of the frame components shown in FIGS. 1A and 1B with an exemplary hanger for mounting the frame on a flat surface such as a wall or appliance according to the present invention.

As noted above, the back 30 has two magnets 10 forming a pair located on opposites sides of the center along the short length of the rectangular picture frame, and two magnets 10 forming a pair located on opposite sides of the center along the long length of the rectangular picture frame. Preferably, the hanger 70 is metal or another material that is attracted to a magnet so that the hanger 70 can engage with either pair of magnets on the back 30. As illustrated in FIG. 6A, the hanger 70 engages the two magnets 10 forming a pair located along the long length of the rectangular picture frame. This configuration will orient the content in a horizontal or landscape mode. By removing the hanger 70 from this pair of magnets 10 and moving the hanger 70 to the other pair of magnets 10, located along the short length of the rectangular picture frame, the user can change the display of the picture frame from the horizontal as depicted to a vertical or portrait orientation.

Figure 6B:
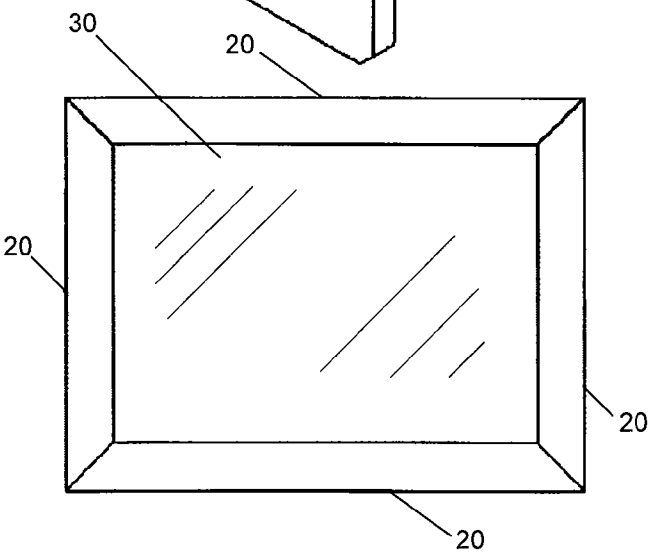
FIG. 6B is a front view of the combination illustrated in FIG. 6A.
Figure 6D:
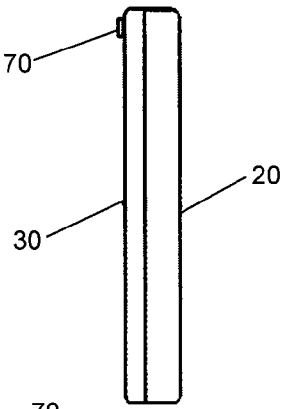
FIG. 6D is a side view of the combination illustrated in FIGS. 6A, 6B, and 6C.
Figure 6C:
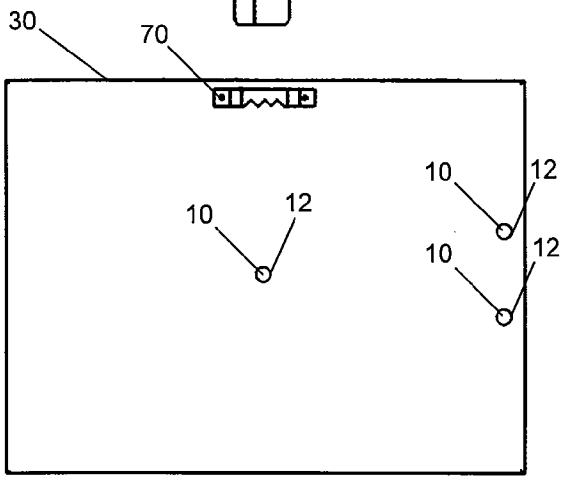
FIG. 6C is a rear view of the combination illustrated in FIGS. 6A and 6B.

FIG. 6A is a rear perspective view, FIG. 6B is a front view, FIG. 6C is a rear view, and FIG. 6D is a side view of the combination forming the picture frame and including an exemplary hanger. These figures illustrate a typical use of the picture frame on a flat surface such as a wall. By including the hanger 70, the picture frame is convertible between a hanging mode and a standing mode, with the hanger 70 acting as the support element in the hanging mode and with the stand 40 acting as the support element in the standing mode.

An example of a suitable type of hanger 70 is the conventional "zigzag" or saw tooth hanger, as shown in FIG. 6A, with a series of saw teeth on its lower edge. The problem with such a hanger is its limited usefulness in terms of its ability to be used with a variety of hanging devices and, more significantly, the fact that it can only provide one type of display mode. The present invention provides a versatile solution for users who want or need multiple support modes (i.e., hanging and standing) without necessarily wanting to purchase two separate hangers. Thus, the hanger 70 overcomes the inability of the stand 40 to assume a flattened or planar position against a wall or other surface when the hanging mode is operative and the stand 40 is not actually needed.

Typically, conventional hangers are attached to frames using a wide variety of fasteners such as nails, screws, hooks, tacks, and the like. These additional components present drawbacks. For example, the fasteners may be lost, they leave holes and marks in the back 30 upon removal, and the process of attaching the fasteners may damage other components such as the hanger 70, the back 30, or the frame edges 20. The magnets 10 avoid these drawbacks.

The present invention also overcomes the difficulties presented by a component that combines a hanger and standing element, such as the convertible frame support disclosed in U.S. Pat. No. 3,990,670 issued to Frechtman. Unlike the Frechtman device, which always includes the frame support regardless of the desired orientation for the picture frame, the modular picture frame of the present invention allows the user to select between the hanger 70 and the stand 40 and only adopt the desired component needed for a particular application.

In summary, the present invention provides a configurable modular picture frame for displaying sheet-like content. The picture frame is relatively inexpensive, simple to manufacture, and easy to assemble and disassemble without tools; does not damage the content while securely supporting the content; and permits simple replacement of the content and reuse of the picture frame. The content can be inserted, securely retained, and easily removed from the picture frame in a matter of seconds with minimal risk of damage to either the content or the picture frame. The components and subcomponents are durable and can be customized by the user. Among the many advantageous features of the picture frame are the following:

1. Magnetic attachment of at least one frame edge;
2. A stand magnetically attached to the frame back;
3. Several configuration options are possible including placement on a horizontal or vertical support surface in an upright or an angled orientation and, by a simple procedure requiring no tools, a picture frame hung vertically may be removed from the wall, have its content replaced, and be re-hung horizontally;
4. A combination of components for all configurations;
5. No need for multiple attachments for appliance, wall, or tabletop or shelf conversion;
6. Attachment of a full three-dimensional picture frame to an appliance;
7. A hanger magnetically attached to the frame back; and
8. The components not made of magnetic material.

The picture frame gives an appearance of high quality and is aesthetically pleasing. Most components of the picture frame, including the edges, back, and stand, are visible when the picture frame displays framed content without detracting from the aesthetic and artistic beauty of the content or the frame. In addition, the invention provides an improved picture frame appearance in that the hanger is designed to remain out of sight behind the picture frame on even the most narrow frame designs, and a decorative back is provided. The picture frame does not hide the content that it holds, but will hide irregular edges of the content especially if matting is used. A picture frame manufacturer may easily use the invention to create picture frames of various sizes and weights to provide durable and strong assemblies which are simple and inexpensive to manufacture.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention. It is expressly intended, for example, that all ranges broadly recited in this document include within their scope all narrower ranges which fall within the broader ranges.

What is claimed:

1. A picture frame for holding and displaying content, the picture frame comprising:

an edge made of a material that is not magnetically attracted, the edge having one segment that is attachable to and detachable from the remainder of the edge, and having a channel for receiving the content;

the edge remainder permanently affixed to a back made of a material that is not magnetically attracted and having a rear face including at least one back magnet for attaching the back to a magnetically attractive surface;

optionally, a stand made of a material that is not magnetically attracted and having a plurality of stand cooperating elements engaging the at least one back magnet to support the back in a plurality of directions and orientations; and, optionally, a hanger made of a magnetically attracted material for engaging the at least one back magnet, thereby attaching the hanger to the back, the hanger configured to engage a fastener and hang the picture frame from the fastener; wherein the edge segment has at least one magnet or cooperating element on each end and/or on its back face; and wherein the edge remainder has at least one magnet or cooperating element on each end for engaging the magnet or cooperating element located on each end of the edge segment to affix the edge segment to the edge remainder and complete the edge around the perimeter of the back, and/or the front face of the back has at least one magnet or cooperating element for engaging the magnet or cooperating element located on the back face of the edge segment to affix the edge segment to the back and complete the edge around the perimeter of the back.

2. The picture frame according to claim 1, wherein the stand is an integral piece including a horizontal base and a first angled leg.

3. The picture frame according to claim 2 wherein the stand further includes a second leg disposed perpendicular to the base.

4. The picture frame according to claim 1, wherein the stand is formed from a horizontal bottom and an upright which is attachable to and detachable from the bottom, the upright having a substantially flat first end and an angled second end with each of the first and second ends including at least one end cooperating element and the bottom having a corresponding at least one bottom cooperating element, the at least one end cooperating element engaging the at least one bottom cooperating element to attach the upright to the bottom.

5. The picture frame according to claim 1, wherein the hanger is configured to engage a fastener and hang the picture frame from the fastener when the stand is not in use.

6. A picture frame kit comprising:

(a) a frame having an edge made of a material that is not magnetically attracted, the edge having one edge segment that is attachable to and detachable from the remainder of the edge, and having a channel for receiving, holding, and displaying content, the edge remainder permanently affixed to;

a back made of a material that is not magnetically attracted and having a rear face including at least one back magnet for attaching the back to a magnetically attractive surface, wherein the edge segment has at least one magnet or cooperating element on each end and/or on its back face; and wherein the edge remainder has at least one magnet or cooperating element on each end for engaging the magnet or cooperating element located on each end of the edge segment to affix the edge segment to the edge remainder and complete the edge around the perimeter of the back, and/or the front face of the back has at least one magnet or cooperating element for engaging the magnet or cooperating element located on the back face of the edge segment to affix the edge segment to the back and complete the edge around the perimeter of the back;

(b) a stand made of a material that is not magnetically attracted and having a plurality of stand cooperating elements engaging the first back magnet to support the back in a plurality of directions and orientations; and (c) a hanger made of a magnetically attracted material for engaging the second back magnet, thereby attaching the hanger to the back, the hanger configured to engage a fastener and hang the frame from the fastener when the stand is not in use.

7. The picture frame kit according to claim 6 wherein the stand is an integral piece including a horizontal base and a first angled leg.

8. The picture frame kit according to claim 7 wherein the stand further includes a second leg disposed perpendicular to the base.

9. The picture frame kit according to claim 6 wherein the stand is formed from a horizontal bottom and an upright which is attachable to and detachable from the bottom, the upright having a substantially flat first end and an angled second end with each of the first and second ends having at least one end cooperating element and the bottom having a corresponding at least one bottom cooperating element, the at least one end cooperating element engaging the at least one bottom cooperating element to attach the upright to the bottom.

10. A picture frame for holding and displaying content, the picture frame comprising:

an edge made of a material that is not magnetically attracted, the edge having an edge segment that is attachable to and detachable from the remainder of the edge and that has a first end and an opposing second end, and having a channel for receiving the content;

the edge remainder permanently affixed to a back made of a material that is not magnetically attracted and having a rear face including a back center magnet for attaching the back to a magnetically attractive surface and at least one back peripheral magnet for attaching the back to the same or a different magnetically attractive surface;

optionally, a stand made of a material that is not magnetically attracted and having a plurality of stand cooperating elements engaging the back center magnet to support the back in a plurality of directions and orientations; and, optionally, a hanger made of a magnetically attracted material for engaging one of the back center magnet or the back peripheral magnet, thereby attaching the hanger to the back, the hanger configured to engage a fastener and hang the picture frame from the fastener;

wherein the edge segment has a pair of magnets located on the first end and on the opposing second end; and wherein the edge remainder has a pair of cooperating elements engaging the pair of magnets to affix the edge segment to the edge remainder and complete the edge around the perimeter of the back.

11. The picture frame according to claim 10, wherein the stand is an integral triangular piece including a horizontal base, a first angled leg, and a second leg disposed perpendicular to the base.

12. The picture frame according to claim 10, wherein the stand is formed from a horizontal bottom and an upright which is attachable to and detachable from the bottom, the upright having a substantially flat first end and an angled second end with each of the first and second ends including at least one end cooperating element and the bottom having a corresponding at least one bottom cooperating element, the at least one end cooperating element engaging the at least one bottom cooperating element to attach the upright to the bottom.

13. The picture frame according to claim 1, wherein the picture frame is rectangular and the edge segment comprises one side of the rectangle.

14. The picture frame according to claim 1, wherein the picture frame has a round shape selected from the group consisting of circle, oval, and ellipse, and the edge segment comprises a portion of the circle, oval, or ellipse of sufficient length to permit insertion of the content into the frame.

15. The picture frame according to claim 1, wherein the magnet or cooperating element of the edge segment is inserted into an aperture so that the magnet or cooperating element is substantially flush with the surface of the edge segment, wherein the magnet or cooperating element of the edge remainder is inserted into an aperture so that the magnet or cooperating element is substantially flush with the surface of the edge remainder, wherein the back magnet is inserted into an aperture so that the magnet is substantially flush with the surface of the rear face of the back, and wherein the magnet or cooperating element of the front face of the back is inserted into an aperture so that the magnet or cooperating element is substantially flush with the surface of the front face of the back.

16. The kit according to claim 6, wherein the frame is rectangular and the edge segment comprises one side of the rectangle.

17. The kit according to claim 6, wherein the frame has a round shape selected from the group consisting of circle, oval, and ellipse, and the edge segment comprises a portion of the circle, oval, or ellipse of sufficient length to permit insertion of the content into the frame.

18. The picture frame according to claim 10, wherein the picture frame is rectangular and the edge segment comprises one side of the rectangle.

19. The picture frame according to claim 10, wherein the picture frame has a round shape selected from the group consisting of circle, oval, and ellipse, and the edge segment comprises a portion of the circle, oval, or ellipse of sufficient length to permit insertion of the content into the frame.

20. The picture frame according to claim 10, wherein the magnet of the edge segment is inserted into an aperture so that the magnet is substantially flush with the surface of the edge segment, and wherein the cooperating element of the edge remainder is inserted into an aperture so that the cooperating element is substantially flush with the surface of the edge remainder.

* * * * *